US005430826A

United States Patent [19]

Webster et al.

[11] Patent Number: 5,430,826

[45] Date of Patent: Jul. 4, 1995

[54] VOICE-ACTIVATED SWITCH

[75] Inventors: Mark A. Webster, Palm Bay; Thomas H. Wright, Indialantic; Gregory S. Sinclair, Palm Bay, all of Fla.

[73] Assignee: Harris Corporation, Melbourne, Fla.

[21] Appl. No.: 959,759

[22] Filed: Oct. 13, 1992

[51] Int. Cl.[6] ..... G10L 5/00

[52] U.S. Cl. ..... 395/2; 395/2.17; 395/2.18; 395/2.23; 395/2.42; 395/2.26; 381/49

[58] Field of Search ..... 381/46, 49; 395/2.17, 395/2.18, 2.19, 2.23, 2.24, 2.42, 2.57, 2.62, 22.72, 2.26

[56] References Cited

U.S. PATENT DOCUMENTS

| | | | |
|---|---|---|---|
| 4,015,088 | 3/1977 | Dubnowski | 381/49 |
| 4,653,098 | 3/1987 | Nakata et al. | 381/49 |
| 4,803,730 | 2/1989 | Thomson | 381/49 |
| 4,811,404 | 3/1989 | Vilmur et al. | 381/94 |
| 4,959,865 | 9/1990 | Stettiner et al. | 381/46 |
| 5,012,519 | 4/1991 | Adlersberg et al. | 381/47 |

OTHER PUBLICATIONS

An efficient, Digitally-Based, Single-Lag Autocorrelation-derived, voice operated transmit (VOX) Algorithm. Webster et al. IEEE Nov. 91.

"An Autocorrelation Pitch Detector and Voicing Decision with Confidence Measures Developed for Noise--Corrupted Speech", by Krubsack and Niederjohn, *IEEE Trans. on Acoustics, Speech and Signal Process.*, vol. 39, No. 2, Feb. 1991.

"Adaptive Silence Deletion for Speech Storage and Voice Mil Applications," by Gan and Donaldson, *IEEE Trans. on Acoustics, Speech and Signal Process.*, vol. 36, No. 6, Jun., 1988. (Copy not yet available).

"A Robust Silence Detector for Increasing Network Channel Capacity," by McAulay, ICC '77, 1977. (Copy not yet available).

"Detection, Estimation, and Modulation Theory" by Van Trees, John Wiley & Sons, New York, 1968. (Copy not yet available).

"Probability, Random Variables, and Stochastic Processes", by Papoulis, McGraw-Hill, New York, 1984. (Copy not yet availaable).

*Primary Examiner*—Allen R. MacDonald
*Assistant Examiner*—Richemond Dorvil
*Attorney, Agent, or Firm*—Charles Wands

[57] ABSTRACT

Human speech is detected in an audio signal by first providing a single autocorrelated signal indicative of the audio signal multiplied by a time-delayed portion of the audio signal, the delay being an amount of time indicative of a period corresponding to a first formant frequency. Portions of the autocorrelated signal are compared with a scaled noise value. Human speech is detected by examining whether a plurality of portions of the autocorrelated signal exceed the scaled noise value.

28 Claims, 3 Drawing Sheets

VOICE-ACTIVATED SWITCH

FIELD OF THE INVENTION

This invention relates to the field of speech detection and more particularly to the field of detecting the presence of human speech in an audio signal.

BACKGROUND OF THE INVENTION

A voice-activated switch provides a signal indicative of the presence of human speech in an audio signal. That signal can be used to activate a tape recorder, a transmitter, or a variety of other audio devices that process human speech.

Human speech contains both voiced (vowel) sounds which are formed using the vocal chords and unvoiced (consonant) sounds which are formed without using the vocal chords. Audio signals containing voiced sounds are characterized by predominant signal components at the resonant frequencies of the vocal chords, called the "formant frequencies". Human vocal chords resonate at a first format frequency between 250 and 750 Hz. The presence of human speech in a sound signal can therefore be detected by detecting the presence of resonant formant frequency components.

One way to detect the predominance of particular frequency components in a signal is by the well known technique of auto-correlation where the signal is multiplied by a time-delayed version of itself. The delay amount is the period corresponding to the frequency of interest. U.S. Pat. No. 4,959,865 to Stettiner et al. discloses using thirty-six separate autocorrelation lags to detect voiced speech and non-speech tones. Stettiner teaches examining the periodicity of the peaks of the thirty-six autocorrelation bins to detect the presence of predominant frequency components at frequencies between fifty and five-hundred Hz. However, providing thirty-six autocorrelations requires a relatively large amount of processing bandwidth and therefore may not be desirable for applications where a relatively large amount of processing bandwidth is not available.

SUMMARY OF THE INVENTION

According to the present invention, human speech is detected in an audio signal by providing a single autocorrelated signal indicative of the audio signal multiplied by a time-delayed portion of the audio signal, the delay being an amount of time indicative of a period corresponding to a first formant frequency, detecting when a portion of the autocorrelated signal exceeds a scaled noise value, and determining when a portion of the audio signal contains human speech according to whether a plurality of portions of the audio signal exceed or do not exceed the scaled noise value.

In an embodiment of the present invention, human speech is detected in an audio signal by deeming a particular portion of the audio signal to contain speech if multiple portions of the autocorrelated signal exceed the scaled noise value when the preceding portion of the audio signal is deemed not to contain speech or if a single portion of the autocorrelated signal exceeds the scaled noise value when the preceding portions of the audio signal is deemed to contain speech. A particular portion of the audio signal is deemed not to contain speech if the autocorrelated signal does not exceed the scaled noise value when the preceding portion of the audio signal is deemed not to contain speech, or if multiple portions of the autocorrelated signal do not exceed the scaled noise value when the preceding portion of the audio signal is deemed to contain speech.

In certain embodiments of the invention, portions of the audio signal which are before and after a portion where speech is detected are also deemed to contain speech.

According further to the present invention, the scaled noise value equals the minimum of forty-eight portions of the audio signal multiplied by a constant value which can be selected by a user.

An advantage of the present invention over the prior art is the use of a single autocorrelation lag. The need for the relatively large amount of processor bandwidth associated with multiple autocorrelation lags used for speech detection is thereby eliminated.

Other advantages and novel features of the present invention will become apparent from the following detailed description of the invention when considered in conjunction with the accompanying drawings.

DESCRIPTION OF THE PREFERRED EMBODIMENTS

Figure 1:
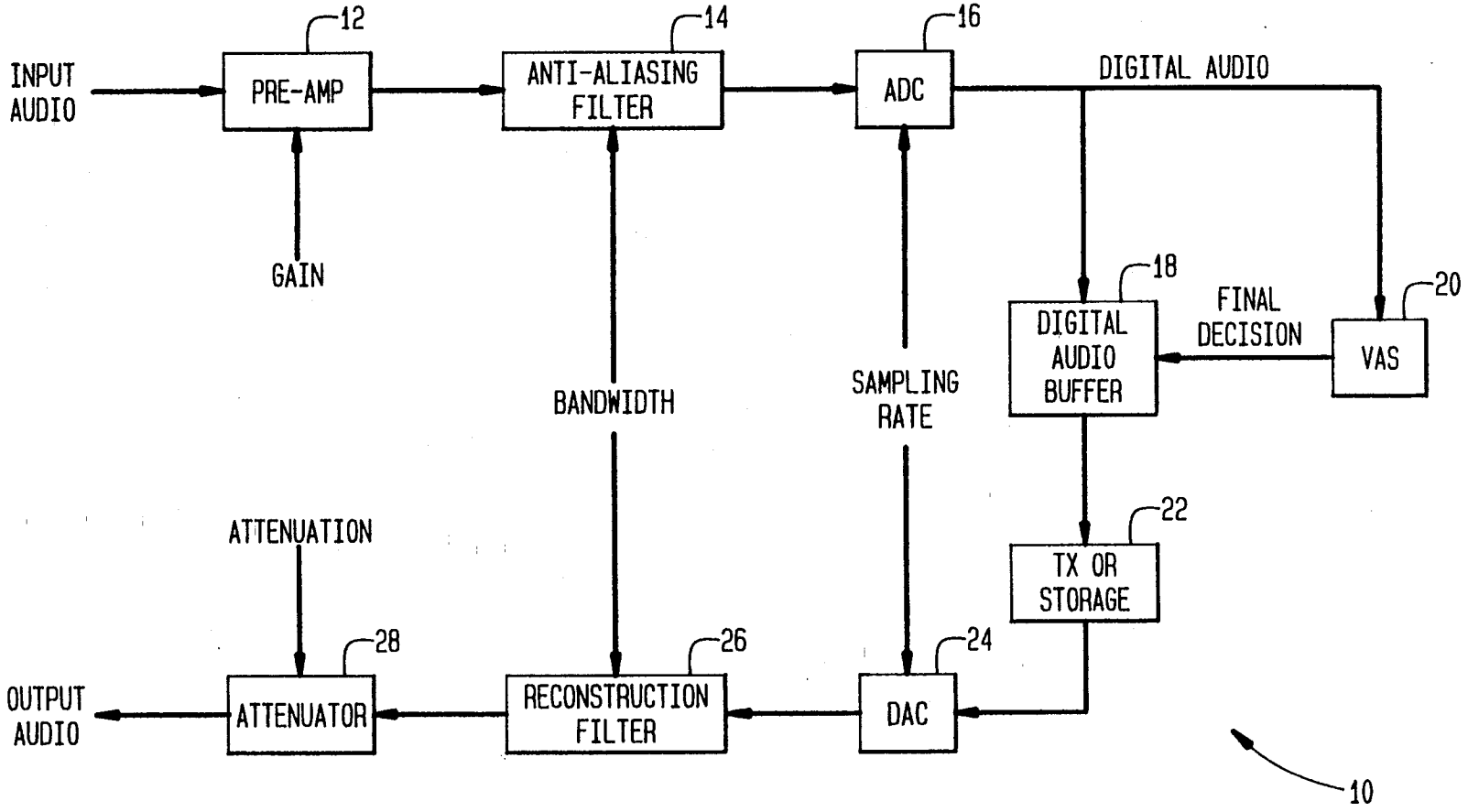
FIG. 1 is a functional block diagram illustrating operation of a sound system constructed in accordance with an embodiment of the invention.

Referring to FIG. 1, an audio system 10 is illustrated by a functional block diagram having boxes and arrows thereon. The arrows represent signals which may be annotated with signal names. The boxes on the diagram represent functional units for processing the signals. Unless otherwise indicated, implementation of the functionality represented by the units is straightforward for one skilled in the art, and can be done with computer software or digital or analog hardware, as appropriate. No portion of the diagram is meant to necessarily convey any temporal relationship between the units.

Referring to FIG. 1, the system 10 represents a generic audio system which could have a variety of specific applications, including, but not limited to, telephone communication, radio communication, and voice recording. The audio system 10 receives a continuous INPUT AUDIO signal and provides an OUTPUT AUDIO signal which either corresponds to the INPUT AUDIO signal if the INPUT AUDIO signal contains a human voice or is a null signal if the INPUT AUDIO signal does not contain a human voice. In other words, the system 10 suppresses the OUTPUT AUDIO signal if the INPUT AUDIO signal does not contain a human voice. When the INPUT AUDIO signal does contain a human voice, the OUTPUT AUDIO signal is set equal to the INPUT AUDIO signal.

The INPUT AUDIO signal is initially provided to a pre-amp 12 which is also provided with a GAIN signal. The pre-amp 12 adjusts the magnitude of the input signal according to the magnitude of the GAIN signal. The GAIN signal is provided by means, known to one skilled in the art, for automatically optimizing the signal to quantization noise ratio for analog to digital conversion of the INPUT AUDIO signal that occurs at a later stage.

The output signal from the pre-amp 12 is provided to an anti-aliasing filter 14, which is a low pass filter that frequency limits the input signal. The output signal of the anti-aliasing filter 14 contains no frequency greater than half the sampling rate associated with analog to digital conversion that occurs at a later stage. The cut-off frequency for the anti-aliasing filter 14 (i.e. the bandwidth) is a design choice based on a variety of functional factors known to one skilled in the art and can range from three kHz for a narrow band audio signal to seven kHz for a wideband audio signal.

Following the anti-aliasing filter 14 is an analog to digital converter 16, which samples the output of the anti-aliasing filter 14 and provides a plurality of digital data values representative of the filter output. The sampling rate is a design choice based on a variety of functional factors known to one skilled in the art and can range between eight kHz for a narrow band audio signal to sixteen Khz for a wideband audio signal.

The output of the analog to digital converter 16 is a DIGITAL AUDIO signal provided to a digital audio buffer 18 and to a voice activated switch (VAS) 20. The digital audio buffer 18 stores a plurality of digital values representative of the DIGITAL AUDIO signal. The VAS 20 examines the DIGITAL AUDIO signal to determine if the DIGITAL AUDIO signal includes a human voice. The VAS 20 outputs a FINAL DECISION signal to the digital audio buffer 18. The FINAL DECISION signal equals a first value when the DIGITAL AUDIO signal (and hence the INPUT AUDIO signal) contains a human voice. The FINAL DECISION signal equals a second value when the DIGITAL AUDIO signal does not contain a human voice. The output of the buffer 18 is suppressed if the FINAL DECISION signal indicates that the DIGITAL AUDIO signal does not include a human voice.

The output of the buffer 18 is delayed because of the delay associated with the VAS 20. For the VAS 20 to determine that a portion of the DIGITAL AUDIO signal from a particular time represents a human voice, the VAS 20 examines portions from before and after that time. The delay in the buffer 18 allows the VAS 20 to accumulate portions of the DIGITAL AUDIO signal that occur after the portion for which the decision is being made. Increasing the delay increases the amount of information available to the VAS 20 and hence tends to increase the accuracy of the VAS 20. However, a substantial delay may not be acceptable for some applications, such as telephone conversation.

The output of the DIGITAL AUDIO buffer 18 is provided to a transmit or storage unit 22, which either transmits or stores the DIGITAL AUDIO signal data. Whether the data is transmitted, stored, or both depends on the particular application of the generic audio system 10 (e.g. telephone communication, voice recording, etc.). The output of the transmit or storage unit 22 is provided to a digital to analog converter 24, which provides a continuous analog signal corresponding to the digital values of the DIGITAL AUDIO signal and to the sampling rate of the analog to digital converter 16. The output of the digital to analog converter 24 is provided to a reconstruction filter 26, a low-pass filter that eliminates high frequency signals that can be created when the DIGITAL AUDIO signal is converted to an analog signal. The output of the reconstruction filter 26 is provided to an attenuator 28, which adjusts the magnitude of the output signal according to the magnitude of an ATTENUATION signal. The ATTENUATION signal is provided by the same or similar means, known to one skilled in the art and discussed above, that provides the GAIN signal and compensates for the change in signal magnitude at the pre-amp 12. The output of the attenuator 28 is the OUTPUT AUDIO signal which, as discussed above, either corresponds to the INPUT AUDIO signal if the VAS 20 detects that the signal contains a human voice, or is a null signal otherwise.

Figure 2:
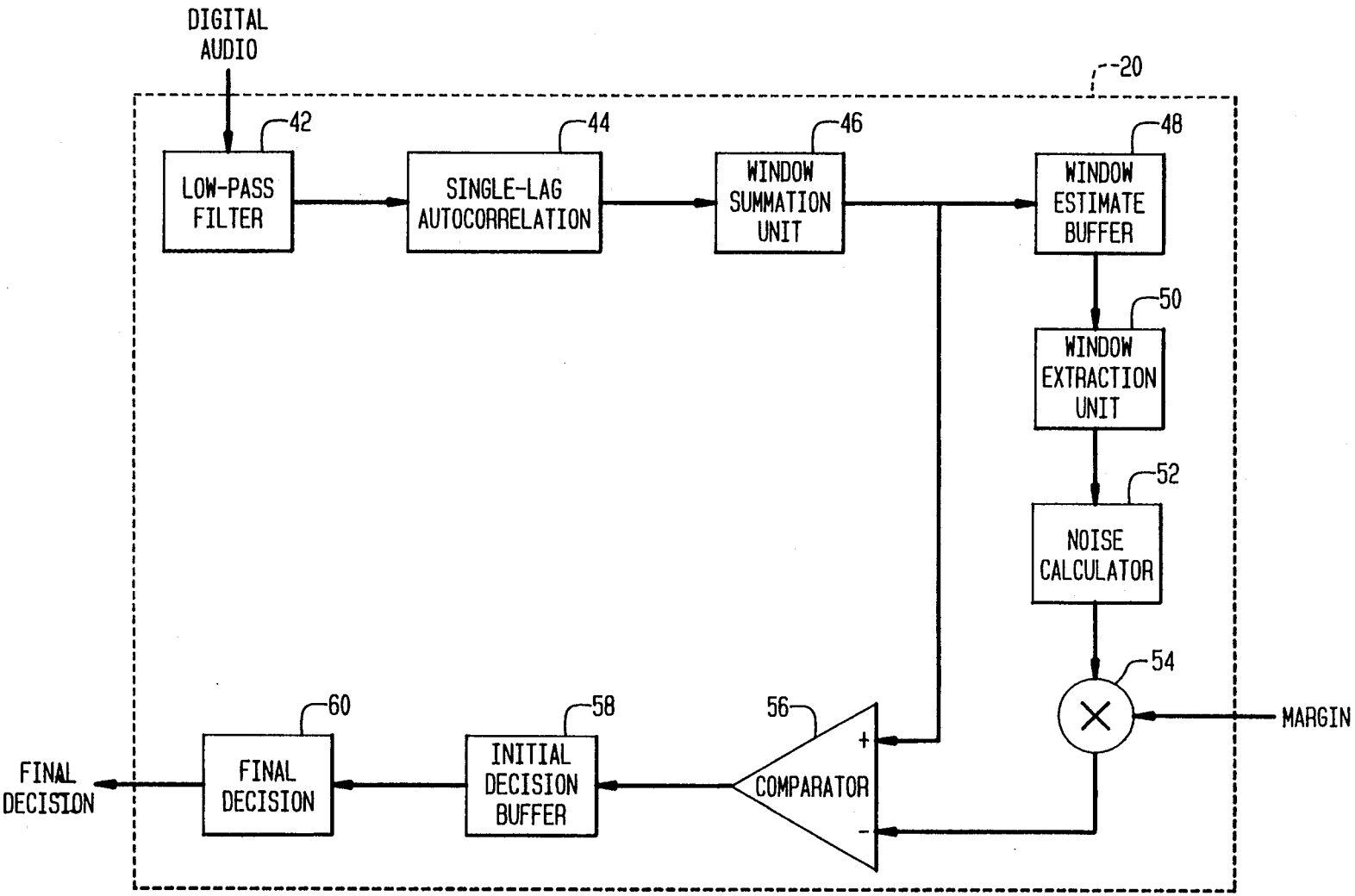
FIG. 2 is a functional block diagram illustrating operation of a voice activated switch constructed in accordance with an embodiment of the invention.

Referring to FIG. 2, a functional block diagram illustrates in more detail the operation of the VAS 20, which examines the DIGITAL AUDIO signal in order to provide a FINAL DECISION signal indicating whether human speech is present. The VAS 20 estimates the amount of background noise (i.e. non-speech noise) in the DIGITAL AUDIO signal and then scales that estimate by a constant. The scaled estimate is then subtracted from a filtered and autocorrelated version of the DIGITAL AUDIO signal. If the result of the subtraction is positive, then the VAS 20 initially determines that the signal contains speech. Otherwise, the VAS 20 initially determines that the signal does not contain speech. Initial decisions obtained for a plurality of portions of the signal are used to provide a value for the FINAL DECISION signal which indicates whether a particular portion of the DIGITAL AUDIO signal contains speech.

The initial decisions only indicate the presence of voiced speech. Therefore, the FINAL DECISION signal indicating the presence of all speech (voiced and unvoiced) is extended to portions of the DIGITAL AUDIO signal that occur both before and after the transitions where voiced speech is initially and finally detected. In other words, if voiced speech is detected to be between times T1 and T2, then the FINAL DECISION signal will indicate that speech is present at portions of the DIGITAL AUDIO signal between a first time which is before T1 to a second time which is after T2. The amount of time which is added before and after the detection of voiced speech is determined empirically and is based upon the maximum amount of time that unvoiced speech can precede or follow voiced speech.

The DIGITAL AUDIO signal is initially provided in the VAS 20 to a digital low-pass filter 42, which improves the signal to noise ratio with respect to the first formant frequency (between 250 and 750 Hz), the resonant frequency of the vocal chords for voiced human speech. The cutoff frequency for the filter 42 is based on a variety of functional factors known to one skilled in the art and ranges between 800 and 1000 kHz.

The output of the digital low-pass filter 42 is provided to a single-lag autocorrelation unit 44, which multiplies the input signal by a portion of the input signal time that is delayed by two msec. The two msec delay is a period corresponding to 500 Hz, the midpoint frequency in the range of the first formant frequency.

Following the autocorrelation unit 44 is a window summation unit 46, which, every thirty-two msec, for example, sums the outputs of the autocorrelation unit 44 to create a single value representing a thirty-two msec window of data. Each window of data represents a portion of the input signal over the thirty-two msec time span. Creating a plurality of thirty-two msec windows effectively provides an integration which smoothes the output signal from the autocorrelation unit 44. Using the windows also decreases the number of quantities upon which the VAS 20 must operate.

The forty-eight most recent window outputs of the window summation unit 46 are stored in a window estimate buffer 48, which is examined periodically (approximately every half second) by a window extraction unit 50. Once each period corresponding to sixteen new windows being entered into the window estimate buffer 48, the window extraction unit 50 outputs the value of the window that has the minimum value among the forty-eight windows. Since the windows represent thirty-two msec in the particularly illustrated embodiment, the window extraction unit 50 examines the window estimate buffer 48 every five hundred and twelve msec (sixteen times thirty-two).

The value of the minimum window, MINW, is provided to a noise calculator 52, which determines the value of an estimate of the background noise, NOISE. The equation used by the noise calculator is:

$$\text{NOISE}=\text{NOISE}+\text{alpha}*(MINW-\text{NOISE})$$

where alpha is a scale factor of the equation that affects the time constant (tc). A time constant is the amount of time required to change the NOISE by 68%. This NOISE is calculated every 512 msec (sixteen times thirty-two msec). The value of alpha is determined using the following equation:

$$\text{alpha}=0.54375/tc$$

For the embodiment of the invention illustrated herein, tc is nominally set to four seconds and hence alpha equals 0.11719. However, for other embodiments, tc can range from two to twelve seconds, depending upon the particular application and on a variety of other functional factors known to one skilled in the art.

The output of the noise estimator 52, NOISE, is provided to a margin scaler 54, which scales the noise estimate according to a margin signal, a multiplier. The noise estimate, NOISE, can be scaled by 3.5 dB, 4.5 dB, 5.5 dB, or 6.5 dB which correspond to multipliers of 1.5, 1.7, 1.9, and 2.1, respectively. The particular value used for the margin scaler 54 can be set externally by a user with a switch (not shown) having four positions corresponding to the four possible values, above. A user could set the switch according to a subjective estimation of performance or according to predetermined performance factors. There are many other possible criteria for selecting switch settings which are based on a variety of functional factors known to one skilled in the art.

The output of the margin scaler 54 is provided to a comparator 56, which subtracts the scaled noise estimate from the most recent output of the window summation unit 46. A positive signal output from the comparator 56 (i.e. the scaled noise is less than the value of the most recent window) corresponds to an initial decision indicating that the most recent window contains speech. A negative output from the comparator 56 corresponds to an initial decision indicating that the most recent window does not contain speech. The output of the comparator 56 is stored in an initial decision buffer 58, which contains the most recent sixteen initial decisions. The initial decision buffer 58 is provided to a final decision unit 60 which determines the value of the FINAL DECISION signal, this process being described below.

Figure 3:
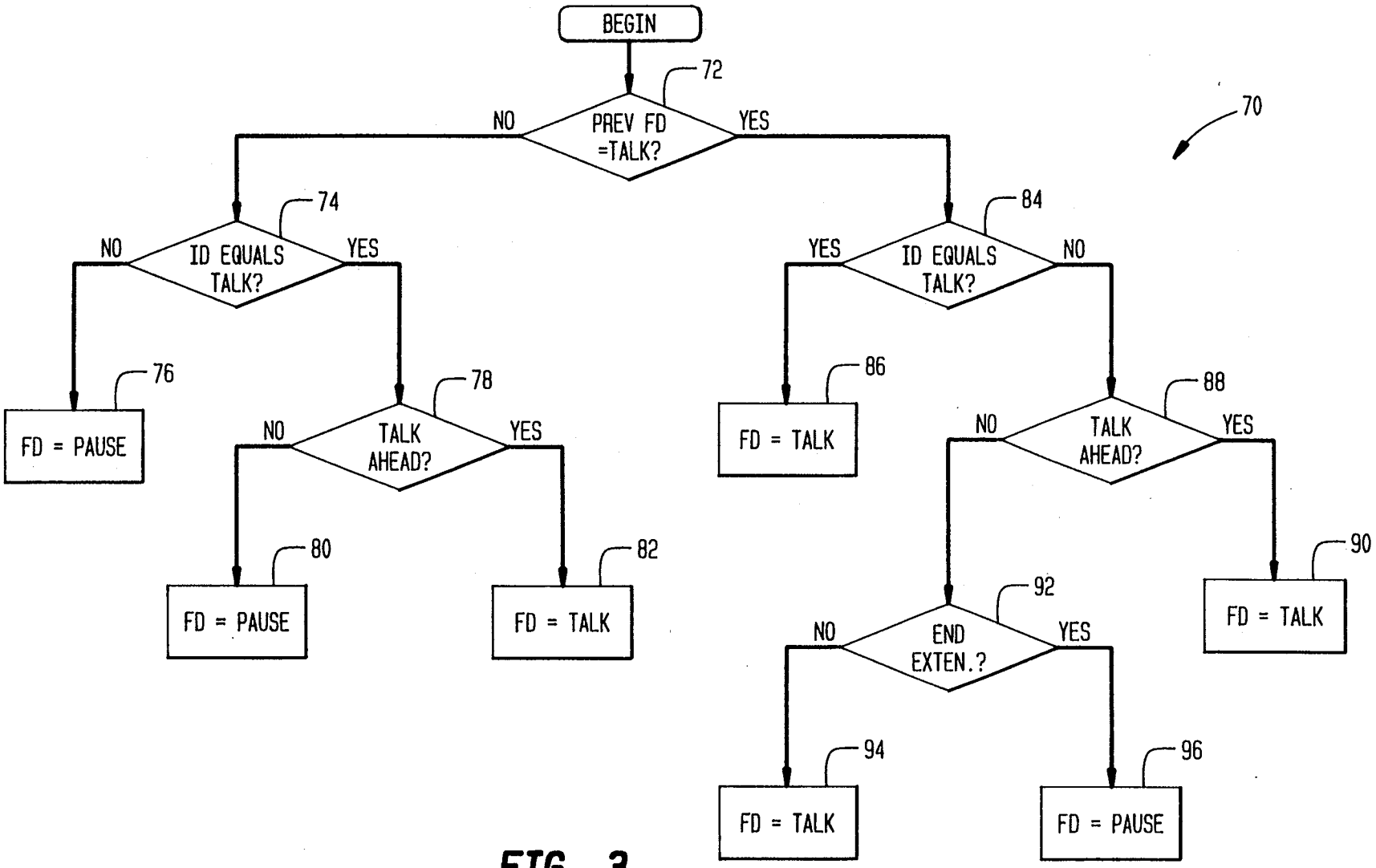
FIG. 3 is a flowchart illustrating processing for part of a voice activated switch constructed in accordance with an embodiment of the invention.

Referring to FIG. 3, a flowchart 70 illustrates in detail an exemplary embodiment of the processing for the final decision unit 60. On the flowchart 70, the term "ID" indicates an initial decision associated with a particular one of the sixteen windows in the initial decision buffer 58. "FD" indicates the FINAL DECISION signal. The FINAL DECISION signal can either correspond to a talk state, indicating that an associated window contains human speech, or can correspond to a pause state, indicating that an associated window does not contain human speech.

Generally, the final decision unit 60 examines the windows in the initial decision buffer 58 and determines the value of the FINAL DECISION signal for the oldest thirty-two msec window in the buffer 58. The oldest (least recent) window is the sixteenth window in the buffer 58 while the most recent window in the buffer 58 is the first window. This examination causes a delay of four five and twelve msec (sixteen times thirty-two msec) for the audio system 10 in the illustrated embodiment.

A first step 72 of the flowchart 70 is a decision step where the value of the FINAL DECISION signal from the previous iteration is examined. Subsequent processing for the final decision unit 60 depends on which branch is taken at the step 72. The system has an inertial quality such that if the previous FINAL DECISION signal indicates a talk state, then the current FINAL DECISION signal is more likely than not to indicate a talk state. Similarly, if the previous FINAL DECISION signal indicates a pause state, then the current FINAL DECISION signal is more likely than not to indicate a pause state.

If the previous value of the FINAL DECISION signal indicates a pause state, control passes from the step 72 to a decision step 74 where the initial decision associated with the twelfth oldest window in the buffer 58 is examined. If the initial decision associated with the twelfth oldest window indicates a pause state, control passes from the step 74 to a step 76 where the FINAL DECISION for the oldest window in the buffer (i.e. the sixteenth window) is set to indicate a pause state.

If, on the other hand, at the step 74 the initial decision for the twelfth window in the buffer 58 indicates a talk state, then control passes from the step 74 to a step 78, where the initial decisions associated with the first through eleventh windows in the buffer 58 are examined. Thus, the time portion that follows the twelfth time portion is examined to determine if there will be any windows having a talk initial decision associated therewith during this following time period. If the initial decision for every one of the first through eleventh windows indicates a pause state, then control passes from the step 78 to a step 80, where the FINAL DECISION signal associated with the oldest (sixteenth) window in the buffer 58 is set to indicate a pause state. Otherwise, if initial decisions associated with the first through eleventh windows indicates a talk state (i.e. there is a talk state ahead of the twelfth window), then the FINAL DECISION signal associated with oldest window in the buffer 58 is set to indicate a talk state. To qualify as a talk state, a number of these eleven windows are searched for a talk state. This number can vary from 3 to 11 but is typically set to 7. Over this number of windows there must be at least one talk state every number of windows. This number can vary from 1 to 10, but is typically set to 4.

Setting the oldest window based on the initial decision for the twelfth window occurs because the VAS 20 detects formant frequencies which correspond to vowel sounds. It is possible for a consonant sound to precede a vowel sound by a time corresponding to up to four windows. Therefore, when a talk initial decision is indicated at the twelfth window, it is possible for speech to have begun at the sixteenth window. To account for this, if at the step 72 the previous FINAL DECISION signal indicates a talk state, then control passes from the step 72 to a decision step 84, where the initial decision associated with the oldest (sixteenth) window in the buffer 58 is examined. If the initial decision associated with the oldest window in the buffer indicates a talk state, then control passes to a step 86, where the FINAL DECISION signal associated with the oldest window in the buffer is set to indicate a talk state. If, on the other hand, at the step 84 the initial decision associated with the oldest window in the buffer indicates a pause state, then control passes from the step 84 to a step 88.

The step 88 is a decision step where the initial decisions associated with the first through the fifteenth windows are examined. If any of the initial decisions associated with the first through the fifteenth windows indicate a talk state (i.e. there is a talk state ahead of the sixteenth window), then the FINAL DECISION signal associated with the oldest window in the buffer (sixteenth) is set to indicate a talk state. Examining all of the windows in the buffer 58 for a talk initial decision compensates for any short pauses that may occur in normal speech.

If at the step 88 none of the initial decisions associated with the first through fifteenth windows in the buffer 58 indicate a talk state, then control passes from the step 88 to a decision step 92 where a test is made to determine if the oldest window is associated with an extension period. If the oldest window is associated with an extension period (discussed below), then control passes to a step 94 where the FINAL DECISION is set to indicate a pause state. Otherwise, control passes to a step 96 where the FINAL DECISION signal is set to indicate a pause state.

The extension period is added to the four windows which immediately follow a transition from a talk state to a pause state and occurs because the VAS 20 detects formant frequencies which correspond to vowel sounds. It is possible for a consonant sound lasting up to four windows to follow the detected vowel sounds. Therefore, even though none of the initial decision indicate a talk state, the FINAL DECISION signals for four windows following a talk state to a pause state transition are set to indicate a talk state.

Although the invention has been illustrated herein using thirty-two msec windows, it will be appreciated by one skilled in the art that the invention can be practiced with windows of different lengths or without using windows at all. Similarly, the number of windows in the window estimate buffer 50 or the number of decisions in the initial decision buffer 58 can be changed without departing from the spirit and scope of the invention.

It will be appreciated by one skilled in the art that the autocorrelation can be performed at a frequency different than that illustrated herein. The amount of the extension added to windows which are before and after detected speech transitions can be varied without departing from the spirit and scope of the invention. The amount and method used for the margin illustrated herein and the particular processing of the initial decisions to provide final decisions can be modified by one skilled in the art.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. Apparatus for detecting human speech in an audio signal, comprising:

a single lag autocorrelation unit, that receives a digital signal representative of the audio signal and provides a respective single-lag autocorrelated signal, representative of each received digital signal multiplied by said each received digital signal delayed by the same period of time corresponding to a first formant frequency;

an initial decision unit for providing initial decisions associated with portions of said single-lag autocorrelated signal, wherein an initial decision indicates a talk state if an associated portion of said single-lag autocorrelated signal exceeds a scaled noise value and wherein said initial decision indicates a pause state otherwise; and a final decision unit that determines when a portion of the audio signal contains human speech according to a plurality of said initial decisions.

2. Apparatus for detecting human speech in an audio signal, according to claim 1, wherein said final decision unit deems a particular portion of the audio signal to contain speech if a final decision associated with an immediately preceding portion of the audio signal indicates a speech state and if an initial decision for the particular portion or a subsequent portion of the single-lag autocorrelated signal indicates a talk state.

3. Apparatus for detecting human speech in an audio signal, according to claim 1, wherein the final decision unit deems a particular portion of the audio signal not to contain speech if an immediately preceding portion of the audio signal is deemed not to contain speech and if the initial decision for the particular portion or a subsequent portion indicates a pause state.

4. Apparatus for detecting human speech in an audio signal, according to claim 1, wherein portions of the audio signal which are before and after a portion where speech is detected are also deemed to contain speech.

5. Apparatus for detecting human speech in an audio signal, according to claim 1, wherein the scaled noise value equals the minimum of a predetermined number of portions of the audio signal multiplied by a constant value.

6. Apparatus for detecting human speech in an audio signal, according to claim 5, wherein the constant value is user selectable.

7. Apparatus for detecting human speech in an audio signal, according to claim 5, wherein the predetermined number of portions is forty-eight.

8. Apparatus for detecting human speech in an audio signal, according to claim 1, wherein the delay is two msec.

9. Apparatus for detecting human speech in an audio signal, according to claim 2, wherein the final decision unit deems a particular portion of the audio signal not to contain speech if an immediately preceding portion of the audio signal is deemed not to contain speech and if the initial decision for the particular portion or a subsequent portion indicates a pause state.

10. Apparatus for detecting human speech in an audio signal, according to claim 9, wherein portions of the audio signal which are before and after a portion where speech is detected are also deemed to contain speech.

11. Apparatus for detecting human speech in an audio signal, according to claim 10, wherein the scaled noise value equals the minimum of a predetermined number of portions of the audio signal multiplied by a constant value.

12. Apparatus for detecting human speech in an audio signal, according to claim 11, wherein the constant value is selected by a user.

13. A voice activated switch for detecting human speech in a sound signal, according to claim 12, wherein the predetermined number of portions is forty-eight.

14. A voice activated switch for detecting human speech in a sound signal, according to claim 13, wherein the delay is two msec.

15. Method of detecting speech in an audio signal, comprising the steps of:

providing a single autocorrelated signal corresponding to the audio signal multiplied by a portion of the audio signal delayed by only a single-lag period of time corresponding to a first formant frequency;

associating a initial decisions with portions of said single-lag autocorrelated signal, wherein an initial decision indicates a talk state if an associated portion of said single-lag autocorrelated signal exceeds a scaled noise value and wherein said initial decision indicates a pause state otherwise; and deeming a portion of the audio signal to contain human speech according to a plurality of initial decisions.

16. Method of detecting speech in an audio signal, according to claim 15, wherein a portion of the audio signal is deemed to contain speech if a final decision associated with an immediately preceding portion of the audio signal indicates a speech state and if an initial decision for the particular portion or a subsequent portion of the single-lag autocorrelated signal indicates a talk state.

17. Method of detecting speech in an audio signal, according to claim 15, wherein a particular portion of the audio signal is deemed not to contain speech if an immediately preceding portion of the audio signal is deemed not to contain speech and if the initial decision for the particular portion or a subsequent portion indicates a pause state.

18. Method of detecting speech in an audio signal, according to claim 15, further comprising the step of:

deeming portions of the audio signal which are before and after a portion where speech is detected as containing speech.

19. Method of detecting speech in an audio signal, according to claim 15, wherein the scaled noise value equals the minimum of a predetermined number of portions of the audio signal multiplied by a constant value.

20. Method of detecting speech in an audio signal, according to claim 19, wherein the constant value is selected by a user.

21. Method of detecting speech in an audio signal, according to claim 19, wherein the predetermined number of portions is forty-eight.

22. Method of detecting speech in an audio signal, according to claim 15, wherein the delay is two msec.

23. Method of detecting speech in an audio signal, according to claim 16, wherein a particular portion of the audio signal is deemed not to contain speech if an immediately preceding portion of the audio signal is deemed not to contain speech and if the initial decision for the particular portion or a subsequent portion indicates a pause state.

24. Method of detecting speech in an audio signal, according to claim 23, wherein portions of the audio signal which are before and after a portion where speech is detected are also deemed to contain speech.

25. Method of detecting speech in an audio signal, according to claim 24, wherein the scaled noise value equals the minimum of a predetermined number of portions of the audio signal multiplied by a constant value.

26. Method of detecting speech in an audio signal, according to claim 25, wherein the constant value is selected by a user.

27. Method of detecting speech in an audio signal, according to claim 26, wherein the predetermined number of portions is forty-eight.

28. Method of detecting speech in an audio signal, according to claim 27, wherein the delay is two msec.

* * * * *